US006847332B2

(12) United States Patent
Thudor et al.

(10) Patent No.: US 6,847,332 B2
(45) Date of Patent: Jan. 25, 2005

(54) SWITCHING DEVICE FOR APPARATUSES FOR RECEIVING AND/OR TRANSMITTING ELECTROMAGNETIC WAVES

(75) Inventors: Franck Thudor, Rennes (FR); Philippe Minard, Rennes (FR); Ali Louzir, Rennes (FR); Françoise Le Bolzer, Rennes (FR)

(73) Assignee: Thomson Licensing S.A., Boulogne-Billancourt (FR)

( * ) Notice: Subject to any disclaimer, the term of this patent is extended or adjusted under 35 U.S.C. 154(b) by 0 days.

(21) Appl. No.: 10/233,792

(22) Filed: Sep. 3, 2002

(65) Prior Publication Data

US 2003/0095073 A1 May 22, 2003

(30) Foreign Application Priority Data

Sep. 4, 2001 (FR) ..... 01 11399

(51) Int. Cl.[7] ..... H01Q 13/10
(52) U.S. Cl. ..... 343/767; 343/768; 343/850
(58) Field of Search ..... 343/767, 768, 343/770, 850

(56) References Cited

U.S. PATENT DOCUMENTS 6,285,333 B1 * 9/2001 Reed et al. ..... 343/767

FOREIGN PATENT DOCUMENTS

EP 0685901 A 5/1995 ..... H01Q/21/20

OTHER PUBLICATIONS

D. Sievenpiper et al. "Low–profile, four–sector diversity antenna on high–impedance ground plane." Electronics Letters, IEE Stevensage (Aug. 3, 2000), vol. 36 No. 16 pp. 1343–1345.

Jeffrey B. Knorr, "Slot–Line Transitions" IEEE Transactions on Microwave Theory and Techniques. (May 1995) vol. 22 pp. 548–554.

M. J. Vaughan et al. "28 GHZ Omni–Directional Quasi–Optical Transmitter Array" vol. 43, No. 10 (Oct. 1, 1995) pp. 2507–2509.

* cited by examiner

*Primary Examiner*—Hoang V. Nguyen
(74) *Attorney, Agent, or Firm*—Joseph S. Tripoli; Robert D. Shedd; Brian J. Cromarty

(57) ABSTRACT

The present invention relates to a device for receiving and/or transmitting signals comprising an assembly of n means for receiving and/or transmitting waves with longitudinal radiation of the printed slot-antenna type, where n is an integer greater than or equal to one, and an excitation means of the microstrip-line type coupled to at least one slot line. The present invention is characterized in that it comprises a switching device which acts by controlling the coupling between the microstrip line and at least one slot line.

24 Claims, 3 Drawing Sheets

SWITCHING DEVICE FOR APPARATUSES FOR RECEIVING AND/OR TRANSMITTING ELECTROMAGNETIC WAVES

BACKGROUND OF THE INVENTION

In known systems for high-throughput wireless transmissions, which can be used especially in a domestic environment, the signals sent by the transmitter reach the receiver along a plurality of separate paths. At the receiver, this results in interference capable of causing fading and distortions of the transmitted signal and consequently a loss or deterioration of the information to be transmitted. To overcome this drawback, directional antennas of the horn, reflector or array type are usually used, these antennas being used for transmission and/or reception and making it possible to combat or attenuate the deterioration related to multiple paths. Specifically, apart from the gain afforded by the directional antenna, the latter makes it possible, by spatial filtering, on the one hand to reduce the number of multiple paths, and hence to reduce the amount of fading, and on the other hand to reduce the interference with other systems operating in the same frequency band.

Since directional antennas do not allow significant azimuthal spatial coverage, French Patent No. 00 15715 filed in the name of the applicant therefore proposed a compact sectorial antenna based on Vivaldi-type antennas. This antenna consists of a "centrifuge" circular arrangement of n Vivaldi-antenna-type printed radiating elements (n being an integer greater than 2), making it possible to present several directional beams sequentially over time. The set of beams provides complete 360° coverage of space.

The switching operation is carried out by virtue of a switch external to the antenna. In general, this switch consists of diodes combined with power-adder/divider circuits and control electronics comprising at least n ports, making it possible to select one or more Vivaldi antennas from the n elements. To ensure acceptable performance in terms of matching, more than one diode is often used on each port. Furthermore, losses from the power-adder/divider circuits are added to the coupling losses of the slotline-microstrip line transition needed for exciting Vivaldi antennas. Finally, the diode state (on or off) is controlled by bias voltages. In order to be able to isolate the voltages provided on each port, circuits blocking the DC current (DC block) are used. These introduce additional losses.

Thus this switching function is often expensive as a result of the price of diodes and the production costs and bulky because of the biasing circuits and the power-adder/divider circuits. Moreover, it introduces not inconsiderable power losses: losses in the divider/adder circuits, losses due to the DC-block and losses in the diodes. These losses result, on reception, in an increase in the noise temperature of the receiver and, on transmission, in a dry loss of the power to be transmitted, which requires overdimensioning of the power amplifier, which may present a very significant additional cost.

SUMMARY OF THE INVENTION

The aim of the present invention is therefore to propose a switching device for apparatuses for receiving and/or transmitting signals, making it possible to reduce the cost, the overall size and the various losses.

Consequently, a subject of the present invention is a device for receiving and/or transmitting signals comprising:

an assembly of n means for receiving and/or transmitting waves with longitudinal radiation of the slot-antenna type, where n is an integer greater than or equal to one, an excitation means electromagnetically coupled to at least the slot of one antenna; and a switching device that acts by controlling the electromagnetic coupling between the excitation means and at least one slot of the slot antenna, characterized in that the switching device comprises:

at least one means for producing a reversible electrical contact between two metallized surfaces defining one slot of the slot antenna (for the description this involves diodes); and a means for controlling the state of the aforementioned contact.

According to one embodiment, the excitation means consists of a microstrip-type supply line. According to a variant, it may consist of a coplanar-type line.

According to another embodiment, the slot antenna consists of at least one slot, printed on a substrate, one end of which flares gradually up to the edge of this substrate while the other end, which is not closed either, extends to another edge of the substrate.

According to another embodiment, the slot antennas are regularly arranged around a single, coplanar point, so as to be able to radiate in a sector with an angle of 360°.

BRIEF DESCRIPTION OF THE DRAWINGS

Other characteristics and advantages of the present invention will become apparent on reading the description of the various embodiments, this description being given below with reference to the appended drawings, in which.

DESCRIPTION OF PREFERRED EMBODIMENTS

Figure 1:
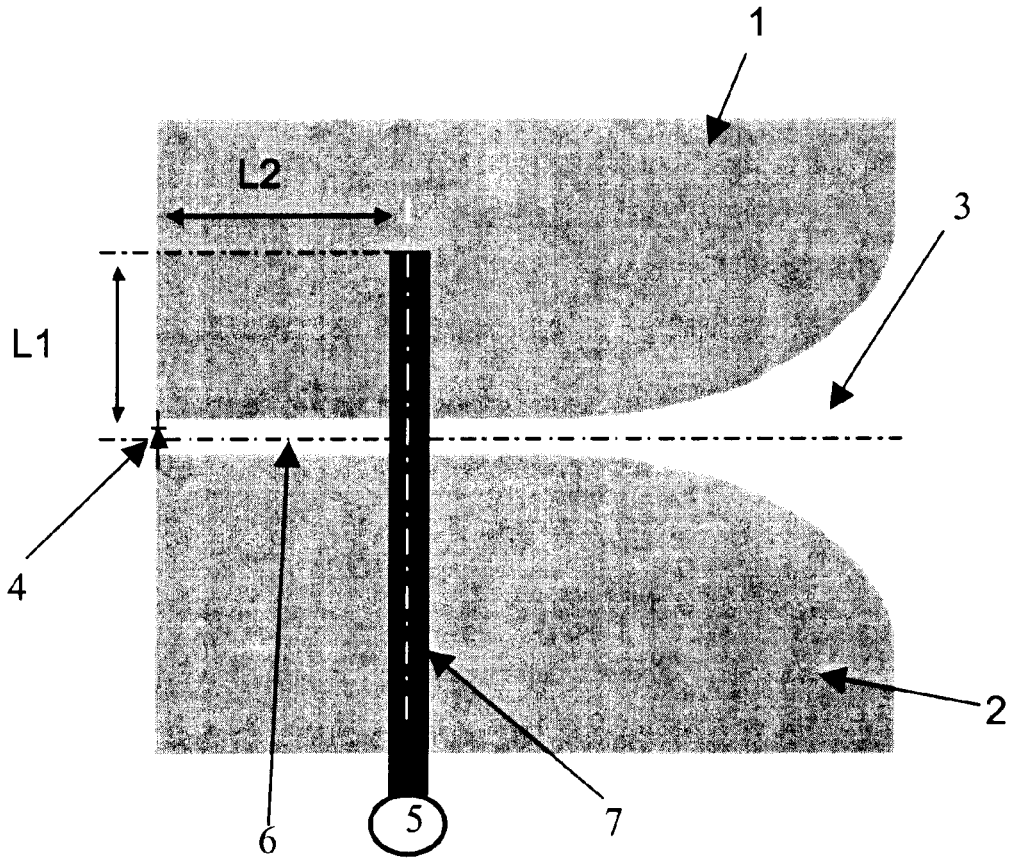
FIG. 1 shows the switching device for a slot antenna.

FIG. 1 shows schematically a Vivaldi-type antenna printed on a substrate 3. The structure and the performance of the Vivaldi antenna are well known to a person skilled in the art and are described especially in documents "IEEE Transactions on Antennas and Propagation" by S. Prasad and S. Mahpatra, Volume 2 AP-31 No. 3, May 1983 and "Study of discontinuities in open waveguide—application to improvement of radiating source model" by A. Louzir, R. Clequin, S. Toutain and P. Gélin, Lest Ura CNRS No. 1329. The supply for the Vivaldi antenna of FIG. 1 is based on the use of a transition between a supply line of the microstrip 7 type and a slot 6. To □ptimisi transmission of energy from the microstrip line to the slot, the unflared end of the slot extends perpendicularly to the microstrip line by a length L2 of about, at the operating frequency, $k'\lambda s/4$ from the microstrip line with $\lambda s=\lambda 0/\sqrt{\epsilon 1reff}$ (with $\lambda 0$ being the wavelength in vacuo and $\epsilon 1reff$ the effective relative permittivity of the slot) and k' an odd integer. As for the microstrip line, it extends to an open circuit located at a length L1 of about $k\lambda m/4$ from the slot where $\lambda m=\lambda 0/\sqrt{\epsilon reff}$ (with $\lambda 0$ being the wavelength in vacuo and $\epsilon reff$ the effective relative permittivity of the line) and k is an odd integer. The other end of the microstrip line is connected to means 5 for transmitting and/or receiving signals of known type, which especially comprise a power amplifier. For fuller details on □ptimising the coupling, reference may be made to document "Slot-line transitions" by Knorr, IEEE, MTT, Vol. 22, pp. 548–554, May 1974 and to document "A Novel MIC Slot-Line Antenna" by Prasad and Mahapatra. Under the conditions described above and presented in FIG. 1, in order to produce the coupling, the unflared end of the slot located at the length k'λs/4 from the microstrip line must terminate in a short circuit. If this end terminates in an open circuit then there is no coupling between the microstrip line and the slot. The invention is based on this control of the coupling.

In order to simulate a short circuit or an open circuit, the end of the slot is not metallized and a device 4, which makes it possible to simulate the short circuit or the open circuit described above, is placed across the slot at a length of about k'λs/4. In FIG. 1, a diode 4 has been positioned, but this could just as well be any other switch, such as for example a diode-mounted transistor or MEMs (microelectromechanical systems). According to the theory developed by Knorr, dimensioning of the slot antenna with quarter wavelengths makes it possible, at the crossover of the microstrip line and of the slot, to produce the impedance opposite that located a quarter wavelength further on: for example, the open circuit located at the end of the microstrip line is equivalent to a short circuit located at the crossover. Furthermore, line theory makes it possible to confirm that the coupling is maximum when, at the crossover, the equivalent impedance of the microstrip line is a short circuit and that of the slot is an open circuit. Thus, the coupling takes place when the diode is on, that is to say when the slot has an open circuit at the crossover and when the microstrip line has a short circuit at the crossover. Conversely, there is no coupling when the diode is off. It is therefore possible to control the coupling and therefore the operation of the antenna by controlling the bias of the diode. To this end, all that is required is to apply carefully chosen biases to the metallized surfaces 1 and 2. For example, it is possible to choose to apply, to the plate 2, either the bias Vcc greater than V, the bias voltage of the diode, if it is desired that it be on, or to connect the surface 2 to earth if it is desired that the diode be off, the surface 1 already being connected to earth.

Thus a switching device is provided, comprising a control circuit which is simple since it controls the application of two biases to metallized surfaces, compact and inexpensive since it consists of a single diode.

An improvement to the present invention is to produce a slot antenna providing 360° sequential coverage of space.

French Patent No. 00 15715, filed in the name of the applicant, proposes a compact antenna making it possible to increase the spectral efficiency of the array by reusing the frequencies by virtue of segmenting the physical space to be covered by the radiation pattern of the sectorial antenna. The antenna proposed in French Patent Application No. 00 15715 consists of a coplanar circular arrangement around a central point of Vivaldi-type printed radiating elements making it possible to present several directional beams sequentially over time, the set of beams giving complete 360° coverage of space.

The receiving and/or transmitting means consist of a microstrip line or a coplanar line crossing all the slots of the printed slot antennas constituting the receiving and/or transmitting means, the length L3 of the line between two slots being equal, at the central operating frequency of the system, to k λm/2 and the length L4 of the line between one end of the line and a slot being about λm/4 where $\lambda m=\lambda 0/\sqrt{\epsilon reff}$ (with λ0 being the wavelength in vacuo and εreff the effective relative permittivity of the line) and k is an integer. Preferably, the length of the line between two slots is equal to k λm so as to obtain in-phase operation of the printed slot antennas.

In this case, the crossover between the slot of the printed slot antenna and the line is preferably produced, at the central operating frequency of the system, at a distance L5 of about a k'λs/4 from the lower end of the slot with $\lambda s=\lambda 0/\sqrt{\epsilon 1}$ reff (λ0 being the wavelength in vacuo and ε1reff. The effective relative permittivity of the slot) and k' an odd integer.

The improvement proposed here relates to the switching system proposed in the previous patent application and consists of an extension of the principle proposed in the present invention to several antennas. The present improvement in fact consists in integrating this switching system directly with the antenna so as to decrease the overall size and the power losses associated with the switching function. The external system (5, 9) which makes it possible to choose the reception or transmission mode of the antenna, which is carried out directly on the microstrip line, will not be described in detail, and only the switching means will be described below.

Unlike French Patent Application No. 00 15715, the lower ends of the slots forming the Vivaldi antennas of the present improvement do not terminate in short circuits: the centre of the overall antenna is free from metallization, which makes it possible to isolate the various metallized plates (M12, M23, M34, M41) forming the slots (A1, A2, A3, A4) and therefore to terminate each one of them with an open circuit. The switching is then carried out by controlling the electromagnetic coupling between the microstrip line and the exciter slot of the Vivaldi-type antenna. The switching principle remains the same as for a single-slot antenna, and is still produced by placing a diode (D1, D2, D3, D4) or any other switch across the slot at a distance of about k'λs/4 from the microstrip line (k' being an odd integer) forming each antenna and making it possible to connect the two metallized surfaces forming the antenna. The switching between the input/output microstrip line to one of the receiving/transmitting, respectively, Vivaldi antennas is controlled by setting the diodes corresponding to the chosen antenna to the on state and by keeping the other diodes in the off state. Switching of the diodes themselves is carried out by applying bias potentials (V12, V23, V34, V41) to the various metallized surfaces (M12, M23, M34, M41, respectively). By varying the biases of two consecutive surfaces, the diode connecting these two surfaces can be rendered either off or on. The description may be extended to the case of n slots (n being an integer greater than or equal to 1) and, in addition, it is possible to choose to render m antennas (m being an integer strictly less than n) of the n antennas present active.

Figure 2:
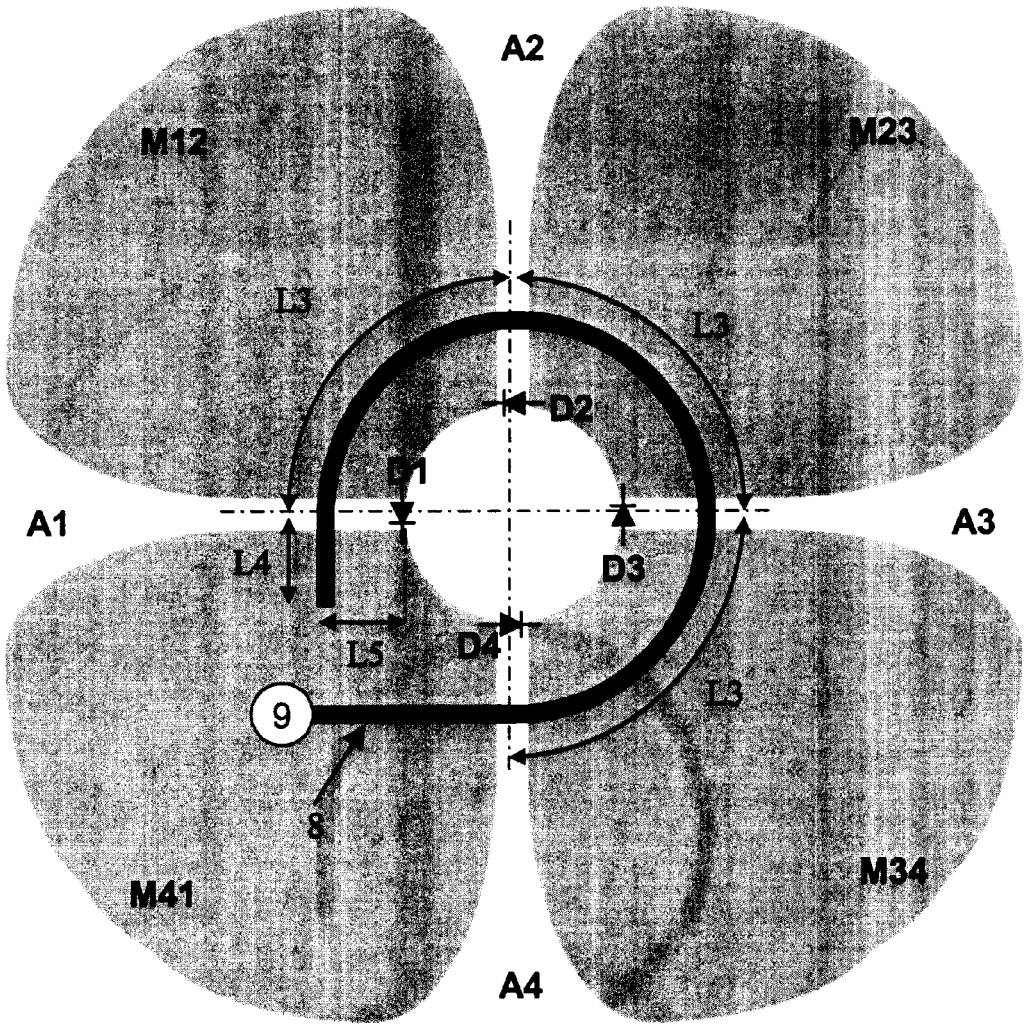
FIG. 2 shows a switching device for a circular arrangement of slot antennas.

The simple four-slot example, as in FIG. 2, will be taken to illustrate the selection in reception or in transmission of the Vivaldi antenna A1. The switching between the input/output microstrip line 8 towards the Vivaldi antenna A1 is controlled by setting the diode D1 to the on state and by keeping the diodes D2, D3, D4 in the off state. This is made possible by applying a bias voltage to each metallized surface. Thus, the surface M12 is set to the potential V12, M23 to V23, M34 to V34 and M41 to V41. In fact, when the bias potential difference (V12−V41) is such that the diode D1 is in the on state (that is, for example (V12−V41)>V1, where V1 is the bias voltage of the diode D1), the diode is equivalent to a short circuit. For the other diodes, the potential difference is less than the bias voltage of the diodes. To simplify the circuit 10 for controlling the bias potentials, all that is required is to apply a potential Vcc>V1 to the surface M12 and to connect all the other surfaces to the earth of the circuit. By applying the principles of coupling between a microstrip line 8 and a slot, mentioned in the description of the present invention, under the conditions described above, the coupling is maximum at the antenna A1 and minimum at the three other antennas A2, A3 and A4. Thus a single antenna from the four was selected in transmission or in reception so as to transmit or receive, respectively. The selection of one antenna out of four is illustrated by the table below with reference to FIG. 3, which gives the values of potential to apply to the various metallized surfaces in order to effect switching:

| | | Potential applied to plates Mij | | | |
|---|---|---|---|---|---|
| | | M12 | M23 | M34 | M41 |
| Excited slot | A1 | Vcc | 0 | 0 | 0 |
| | A2 | 0 | Vcc | 0 | 0 |
| | A3 | 0 | 0 | Vcc | 0 |
| | A4 | 0 | 0 | 0 | Vcc |

The device needed for the present improvement consists of 4 diodes, which are placed across the slots, and of a small control circuit, which makes it possible to manage the various potentials of the metallized surfaces. This device 10 may be inserted in the middle of the antenna since the latter consists of substrates, so as to limit the length of the connection wires as much as possible. The complete switching device is therefore very compact and reduces losses because of the small number of diodes and the simplicity of the circuit controlling the bias potentials.

According to an improvement of the present invention, it is possible, furthermore, to choose to render m antennas (m being an integer strictly less than n) from the n antennas present active. It is possible to again take the simple example given above with four slots and to choose to make two of these slots active at the same time. All that is then needed is to again take the same assembly as described above and to modify the control circuit so that it can apply, for the four-slot example, three different potentials: a zero potential, that is to say to connect the metallized surface to earth, a potential Vcc with Vcc greater than the largest of the bias voltages of the diodes if they are different, and a potential equal to twice Vcc. The table below makes it possible to illustrate this selection of two slots out of four, with reference to FIG. 3, by giving the values of potentials to apply to the various plates in order to select the desired slots:

| | | Potential applied to plates Mij | | | |
|---|---|---|---|---|---|
| | | M12 | M23 | M34 | M41 |
| Excited slots | A1 and A2 | Vcc | 2*Vcc | 0 | 0 |
| | A1 and A3 | Vcc | 0 | V | 0 |
| | A1 and A4 | 2*Vcc | 0 | 0 | Vcc |
| | A2 and A3 | 0 | Vcc | 2*Vcc | 0 |
| | A2 and A4 | 0 | Vcc | 0 | Vcc |
| | A3 and A4 | 0 | 0 | Vcc | 2*Vcc |

Figure 3:
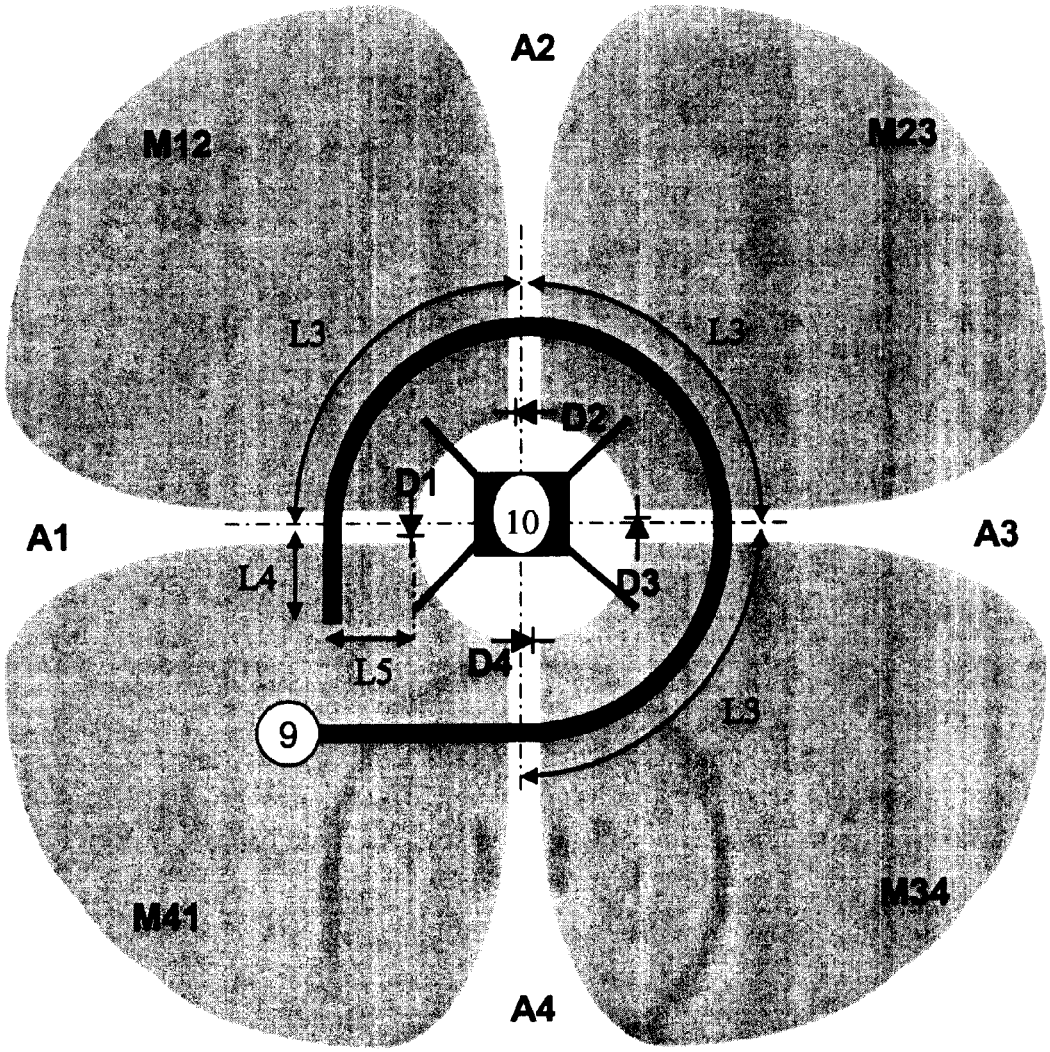
FIG. 3 shows a switching device for a circular arrangement of slot antennas including the control means.

Thus a relatively simple system for switching between the various slots of the complete antenna is obtained since the control circuit is reduced to a voltage selector that can be inserted into the middle of the metallized surfaces as in FIG. 3 so as to reduce the overall size of the circuit. In addition, the power losses are reduced to those due to the coupling, which cannot be modified, and to those due to the bias of the diodes, the number of which is less than that of the switching devices proposed in the prior art.

It is obvious for a person skilled in the art that the embodiments described above may be modified, especially with regard to the number of Vivaldi antennas or the type of supply to the structure, etc., without departing from the scope of the claims below.

What is claimed is:

1. Device for receiving and/or transmitting signals comprising:

an assembly of n means for receiving and/or transmitting waves with longitudinal radiation of the slot-antenna type, where n is an integer greater than or equal to one;

an excitation means electromagnetically coupled to at least the slot of one antenna;

a switching device that acts by controlling the electromagnetic coupling between the said excitation means and at least one slot of the slot antenna, wherein the switching device comprises:

at least one means for producing a reversible electrical contact between two metallized surfaces defining one slot of the slot antenna; and a means (10) for controlling the state of the reversible electric contact;

wherein the means for producing a reversible electrical contact between two metallized surfaces defining a slot of the slot antenna are placed through the slot at a distance close to $k'\lambda s4$ from the excitation means, with $\lambda s=\lambda 0/\sqrt{\epsilon 1reff}$ ($\lambda 0$ being the wavelength in a vacuum and $\epsilon 1reff$ the effective relative permittivity of the slot) and k' is an odd integer.

2. Device according to claim 1, wherein the said excitation means comprises a supply line of coplanar-line type or of microstrip-line type.

3. Device according to claim 1, wherein the slot antenna comprises at least one slot, printed on a substrate, one end of which flares gradually up to the edge of this substrate while the other end, which is not closed either, extends to another edge of the substrate.

4. Device according to claim 3, wherein the crossover between a slot of the printed slot antenna and the excitation means occurs, at the central operating frequency of the system, at a distance of about $k'\lambda s/4$ from the unflared end of the slot where $\lambda s=\lambda 0/\sqrt{\epsilon 1reff}$ ($\lambda 0$ being the wavelength in a vacuum and $\epsilon 1reff$ is the effective relative permittivity of the slot) and k' is an odd integer.

5. Device according to claim 4, wherein the line length between one end of the excitation means and a slot is about $k\lambda m/4$ where $\lambda m=\lambda 0/\sqrt{\epsilon reff}$ with $\lambda 0$ being the wavelength in vacuo and $\epsilon reff$ the effective relative permittivity of the microstrip line and k is an odd integer.

6. Device according to claim 1, wherein the n means for receiving and/or transmitting waves with longitudinal radiation of the printed slot-antenna type are arranged to receive a broad azimuttal sector.

7. Device according to claim 6, wherein the switching device makes it possible to render n means for receiving and/or transmitting waves with longitudinal radiation of the printed slot-antenna type from the n means present active at the same time, where m is an integer less than n.

8. Device according to claim 6, wherein the slot antennas are regularly arranged around a single, coplanar point, so as to be able to radiate in a sector with an angle of 360°.

9. Device according to claim 1, wherein a means for producing a reversible electrical contact between two metallized surfaces defining a slot of the antenna is a control switch.

10. Device according to claim 9, wherein a means for producing a reversible electrical contact between two metallized surfaces defining a slot of the antenna is a diode, a diode-mounted transistor or a MEMs (microelectromechanical System).

11. Device according to claim 1, wherein the means for controlling the state of the reversible contact of a slot is the application of a potential to the two metallized surfaces defining this slot, allowing the controlled switch to close.

12. Device according to claim 1, wherein the slot antenna is of the Vivaldi-antenna type.

13. Device for receiving and/or transmitting signals comprising:

an assembly of n means for receiving and/or transmitting waves with longitudinal radiation of the slot-antenna type, where n is an integer greater than or equal to one, the slot antenna comprising at least one slot having one end of which is not closed either;

an excitation means electromagnetically coupled to at least the slot of one antenna; and a switching device that acts by controlling the electromagnetic coupling between the said excitation means and at least one slot of the slot antenna, wherein the switching device comprises at least one means for producing a reversible electrical contact between two metallized surfaces defining one slot of the slot antenna; and a means (10) for controlling the state of the reversible electric contact, wherein the crossover between a slot of the printed slot antenna and the excitation means occurs, at the central operating frequency of the system, at a distance of about $k'\lambda s/4$ from the unflared end of the slot where $\lambda s=\lambda 0/\sqrt{\epsilon 1reff}$ ($\lambda 0$ being the wavelength in a vacuum and $\epsilon 1reff$ is the effective relative permittivity of the slot) and k' is an odd integer.

14. Device according to claim 13, wherein the said excitation means consists of a supply line of coplanar-line type or of microstrip-line type.

15. Device according to claim 13, wherein the slot antenna consists of at least one slot, printed on a substrate, the one end extending to an edge of the substrate and being not closed either, and other end of which flares gradually up to the edge of this substrate while.

16. Device according to claim 15, wherein the line length between one end of the microstrip line and a slot is about $k\lambda m/4$ where $\lambda m=\lambda 0/\sqrt{\epsilon reff}$ with $\lambda 0$ being the wavelength in vacuo and $\epsilon reff$ the effective relative permittivity of the microstrip line and k is an odd integer.

17. Device according to claim 16, wherein the switching device makes it possible to render n means for receiving and/or transmitting waves with longitudinal radiation of the printed slot-antenna type from the n means present active at the same time, where m is an integer less than n.

18. Device according to claim 16, wherein the slot antennas are regularly arranged around a single, coplanar point, so as to be able to radiate in a sector with an angle of 360°.

19. Device according to claim 13, wherein the n means for receiving and/or transmitting waves with longitudinal radiation of the printed slot-antenna type are arranged to receive a broad azimuttal sector.

20. Device according to claim 13, wherein the means for producing a reversible electrical contact between two metallized surfaces defining a slot of the slot antenna are placed through the slot at a distance close to $k'\lambda s/4$ from the excitation means, with $\lambda s=\lambda 0/\sqrt{\epsilon 1reff}$ ($\lambda 0$ being the wavelength in a vacuum and $\epsilon 1reff$ the effective relative permittivity of the slot) and k' is an odd integer.

21. Device according to claim 20, wherein a means for producing a reversible electrical contact between two metallized surfaces defining a slot of the antenna is a control switch.

22. Device according to claim 21, wherein a means for producing a reversible electrical contact between two metallized surfaces defining a slot of the antenna is a diode, a diode-mounted transistor or a MEMs (microelectromechanical System).

23. Device according to claim 20, wherein the means for controlling the state of the reversible contact of a slot is the application of a potential to the two metallized surfaces defining this slot, allowing the controlled switch to close.

24. Device according to claim 13, wherein the slot antenna is of the Vivaldi-antenna type.

* * * * *